United States Patent [19]

Kikuchi et al.

[11] Patent Number: 4,714,044

[45] Date of Patent: Dec. 22, 1987

[54] PAINTING APPARATUS FOR VEHICLE BODY

[75] Inventors: Uhee Kikuchi, Sayama; Tadashi Takeo, Sakado, both of Japan

[73] Assignee: Honda Giken Kogyo Kabushiki Kaisha, Tokyo, Japan

[21] Appl. No.: 881,302

[22] Filed: Jul. 2, 1986

[30] Foreign Application Priority Data

Jul. 2, 1985 [JP] Japan ..... 60-143900

[51] Int. Cl.[4] ..... B05B 13/04; B05B 15/12; B05D 1/02

[52] U.S. Cl. ..... 118/314; 118/315; 118/323; 118/326; 901/43; 239/751; 239/752

[58] Field of Search ..... 239/752, 751; 118/323, 118/314, 315, 326; 427/421, 424; 901/43

[56] References Cited

U.S. PATENT DOCUMENTS 4,239,431 12/1980 Davini ..... 414/1
4,342,535 8/1982 Bartlett et al. ..... 414/1
4,342,536 11/1982 Akeel et al. ..... 414/1
4,362,124 12/1982 Fleig ..... 118/314
4,498,414 2/1985 Kiba et al. ..... 118/323
4,521,462 6/1985 Smythe ..... 427/421
4,532,148 7/1985 Vecellio ..... 427/31
4,552,506 11/1985 Cummins et al. ..... 414/1
4,630,567 12/1986 Bambousek et al. ..... 118/323

FOREIGN PATENT DOCUMENTS 3301022 7/1984 Fed. Rep. of Germany .
144763 11/1981 Japan .

*Primary Examiner*—Shrive P. Beck
*Attorney, Agent, or Firm*—Armstrong, Nikaido, Marmelstein & Kubovick

[57] ABSTRACT

A painting apparatus for a vehicle body is provided. The painting apparatus comprises a long paint booth through which the vehicle is conveyed, the paint booth including a plurality of stages positioned longitudinally in series, at least some of the plurality of stages being provided with painting robots disposed therein such that while the vehicle body is passed through the painting booth, inner and outer panel regions thereof are painted by the painting robots, wherein the vehicle body is stopped at each of the stages. Each of the painting robots comprises a multi-axis robot and bell-type atomizer attached thereto, and the plurality of stages are in communication with one another without partitions therebetween.

5 Claims, 21 Drawing Figures

PAINTING APPARATUS FOR VEHICLE BODY

BACKGROUND OF THE INVENTION

1. Field of the Invention:

This invention is related to a painting apparatus for a vehicle body wherein the vehicle body of a motorcar or the like is automatically painted.

2. Description of the Prior Art:

In prior art vehicle painting apparatuses, a vehicle body is arranged to be conveyed at a constant speed and passed longitudinally through a long painting booth including plural stages disposed in a line longitudinally. A bell-type atomizer, attached to a reciprocator, is provided at left and right positions or at a top position at desired selected stages to reciprocate upwards and downwards or leftwards and rightwards for electrostatically painting an outer panel region of the vehicle body. A painting robot carrying an air-spray gun attached thereto is provided at other selected stage(s) for electrostatically painting an inner panel region of the vehicle body. Thus, when the vehicle body has been passed through the paint booth, the body has the inner and outer panel regions already painted.

This conventional type of vehicle painting apparatus, however, is troublesome in maintenance and inspection thereof, because different kinds of painting devices are used. In particular, the reciprocator is equipped with a bell-type atomizer, and the painting robot is equipped with an air-spray gun. Accordingly, a modification thereof has been considered in which the painting robot equipped with the air-spray gun attached thereto which is used for painting both the outer panel region and the inner panel region of the vehicle body.

However, this modified type of painting apparatus is defective in that the electrostatic painting efficiency of the air-spray gun is low, i.e., about 40% in paint transfer efficiency. Thus, it becomes necessary to carry out a supplementary or additional painting, resulting in the lowering of productivity. In addition, the sprayed paint disperses in all directions in a wide range, and therefore, for preventing the dispersion of the sprayed paint to an adjacent stage, it is necessary that a partition means be provided between the mutually adjacent stages. The partition means can be opened and closed at will. If there is no partition means, than a large space is formed between the adjacent stages. The partition means can give rise to such problems as increased cost for installation thereof and increased spaces.

In addition, if the vehicle body is painted while being conveyed at a constant speed, there is a problem in that the vehicle body is liable to be out of position as a result of the vibrations of the conveyor. A defective or unreliable painting of the vehicle body can thus result.

In another type of prior art painting apparatus, a vehicle body is conveyed and then is stopped at the interior of a paint module which is arranged to be completely sealed. Under the sealed condition, the vehicle body is painted over the inner panel region and the outer panel region thereof, by plural painting robots disposed in the paint module. This type of apparatus, however, is defective in that the time for keeping the vehicle body in its stopped condition is very long, so that the apparatus cannot be synchronized with the tact-conveying motion of the production line, and thus is not suitable for large production.

There has been developed and put on the market a light weight and small-sized bell-type atomizer. This is an improvement of the heavy weight and large-sized bell-type atomizer known in the prior art.

SUMMARY OF THE INVENTION

This invention has for its object to provide an apparatus which can eliminate the foregoing problems, by using a painting robot equipped with a light and miniaturized bell-type atomizer.

According to the present invention, an apparatus is provided in which a vehicle body is arranged to be conveyed in the longitudinal direction of a long paint booth which includes plural stages disposed longitudinally in a series relationship. Several of the stages are provided with painting robots so that while the vehicle body is passed through the paint booth, the inner and outer panel regions thereof may be painted by the painting robots. The present invention is characterized in that the vehicle body is arranged to be tact-conveyed and to be stopped at each of the stages, and each of the painting robots is comprised of a multi-axis robot carrying a light and small bell-type atomizer attached thereto. The stages are in communication with one another without being partitioned from one another.

DETAILED DESCRIPTION OF THE PREFERRED EMBODIMENT

Figure 1:
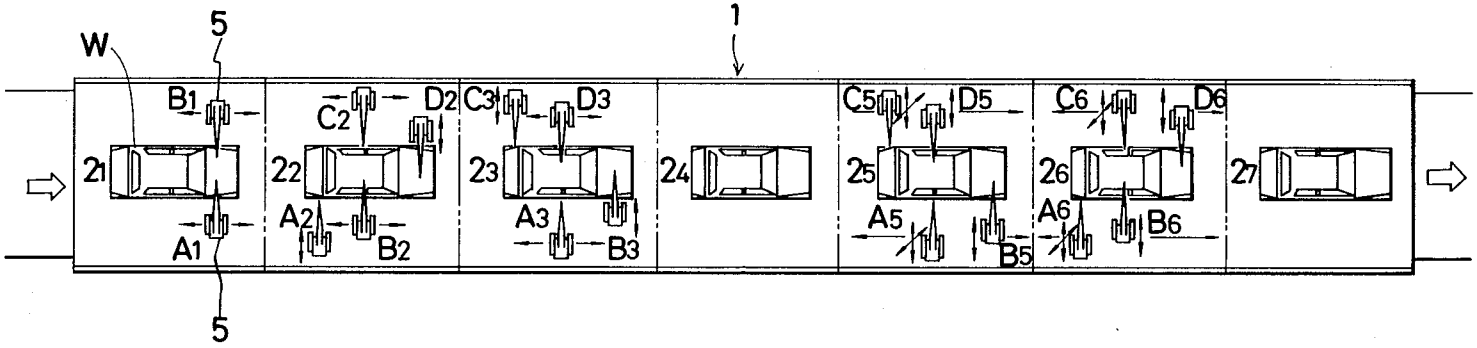
FIG. 1 is a schematic top plan view of one embodiment of the present invention.

Referring to FIG. 1, a long paint booth 1 includes seven stages $2_1$, $2_2$, . . . $2_7$ longitudinally disposed in series in a front to rear relationship. In the paint booth 1, a vehicle body W is arranged to be tact-conveyed from an inlet side towards an outlet side and to be stopped at each of the stages $2_1$, $2_2$ . . . $2_7$, by means of the conveyor 4 shown in FIG. 2, when placed on a carrier 3. In the illustrated embodiment, the first to third stage $2_1$, $2_2$, $2_3$ and the fifth and sixth stages $2_5$, $2_6$ are formed to serve as painting stages as described hereinafter, and each of these stages is provided with painting robots 5 disposed at predetermined positions such that when the vehicle body W is being passed through the paint booth 1, inner and outer panel regions thereof may be painted by the painting robots 5.

Figure 2:
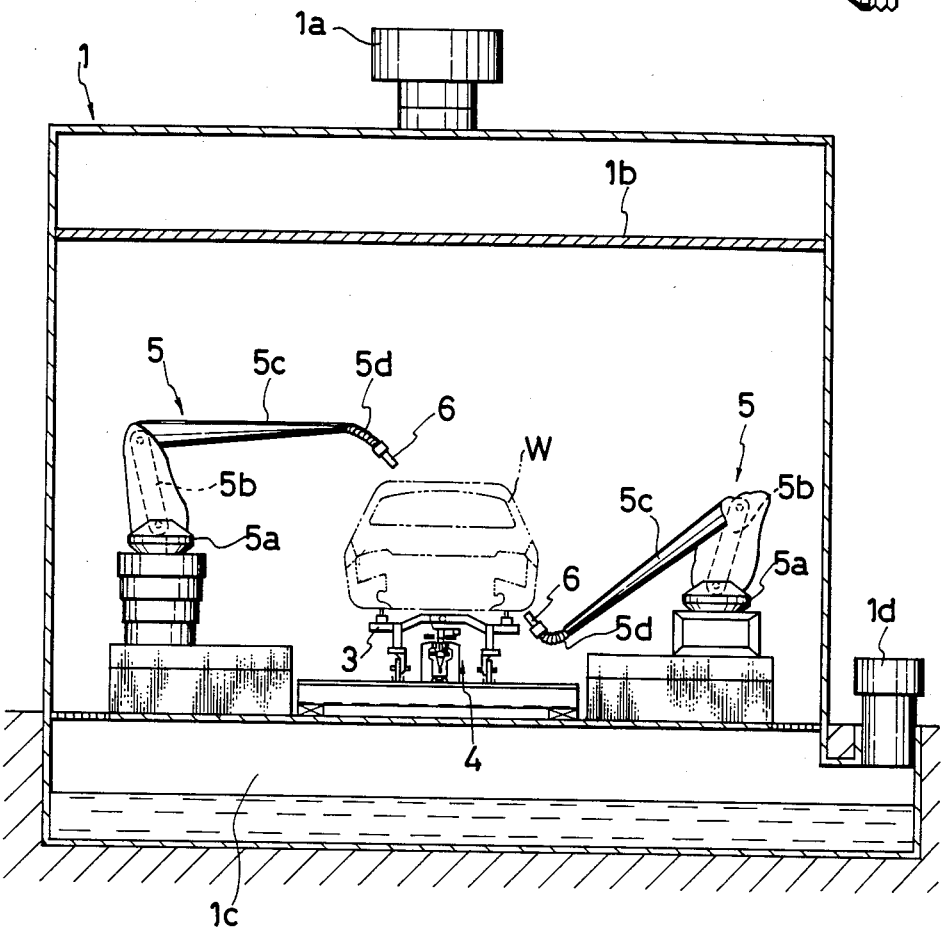
FIG. 2 is a lateral cross-sectional view of a paint booth thereof.

Referring to FIG. 2, numeral 1*a* denotes an air supply duct, numeral 1*b* denotes an air filter, numeral 1*c* denotes a paint recovery tank and numeral 1*d* denotes an air discharging duct.

Figure 3:
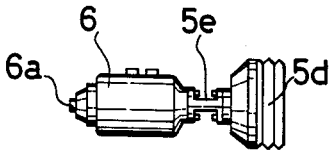
FIG. 3 is an enlarged view of the forward end portion of a painting robot used therein.

The painting robot 5 comprises a 6-axis unit including a turning base 5*a*, a first arm 5*b* which is swingably provided thereon, a second arm 5*c* which is pivotally connected to the first arm 5*b* so that it is swingable upwards and downwards, and a 3-axis wrist portion 5d mounted on a forward end of the second arm 5c. A small-sized and light weight bell-type atomizer 6 is attached, through a bracket 5e, to the wrist portion 5d, as shown in FIG. 3.

The atomizer 6 is of a type such as that manufactured by Japan Ranzburg Co., Ltd. which has a bell 6a on its forward end which is 25 mm in diameter, a bell driving shaft and a turbine rotor on its rear end (not shown), respectively, 15 mm and 31 mm in diameter, and the total weight thereof is about 3 kg. The atomizer 6 is used for electrostatically painting by rotating the bell 6a thereof at a high speed of more than 60,000 r.p.m. and applying thereto a high voltage of from −60 to −120 KV. In this case, the paint transfer efficiency thereof becomes such a high value as above 80%.

The foregoing respective stages $2_1$, $2_2$, . . . $2_7$ are disposed in a line in communication with one another in the longitudinal direction of the paint booth 1 without being partitioned from one another. The first stage $2_1$ on the inlet side of the paint booth 1 serves as a painting stage for painting corner portions of the vehicle body W such as a wheel arch of a fender Wa, a front end of a bonnet Wb, a front end of a roof Wc or the like. The second and third stages $2_2$, $2_3$ serve as painting stages for painting an inner panel region of the vehicle body W such as an inner surface of the bonnet Wb, an engine space Wd, a peripheral edge of a door We and a door opening portion, an inner surface of a trunk lid Wf, and an upper edge of a trunk space or the like. The fourth stage $2_4$ serves as a stage for pre-drying, and the fifth and sixth stages $2_5$, $2_6$, serve as painting stages for painting an outer panel region of the vehicle body W. The seventh stage $2_7$ is formed to serve as a stage for pre-drying.

Figure 4A:
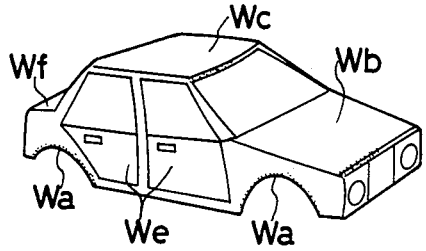
FIGS. 4*a* and 4*b* are perspective views showing painted portions at the first stage thereof.
Figure 4B:
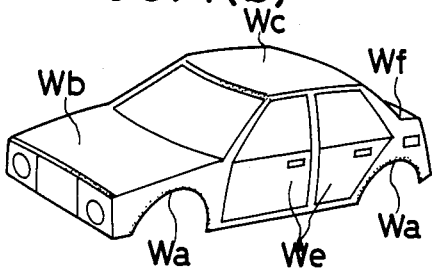
Figure 5A:
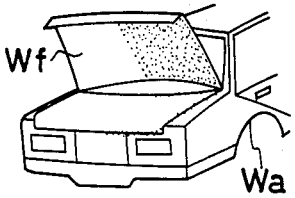
FIGS. 5*a*–5*d* are perspective views showing painted portions at the second stage thereof.
Figure 6A:
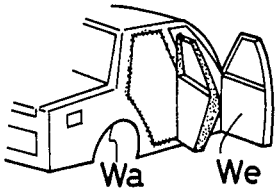
FIGS. 6*a*–6*d* are perspective views showing painted portions at the third stage thereof.
Figure 5B:
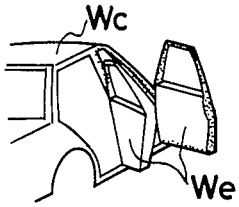
Figure 6B:
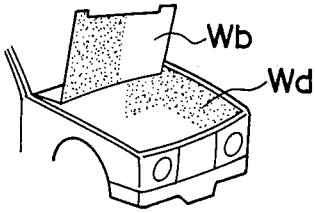
Figure 5C:
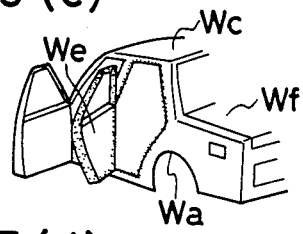
Figure 6C:
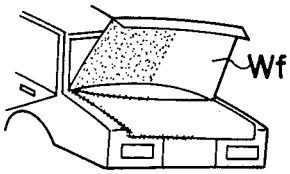
Figure 5D:
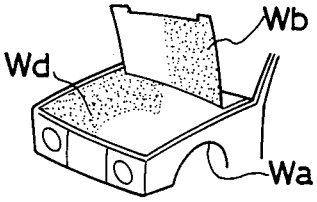
Figure 6D:
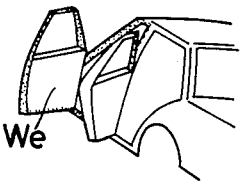
Figure 7A:
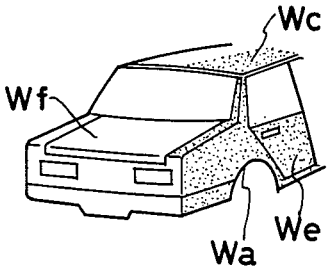
FIGS. 7*a*–7*d* are perspective views showing painted portions at the fifth stage thereof.
Figure 8A:
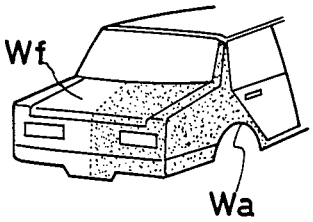
FIGS. 8*a*–8*d* are perspective views showing painted portions at the sixth stage thereof.
Figure 7B:
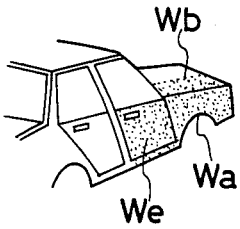
Figure 8B:
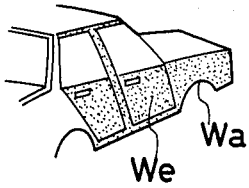
Figure 7C:
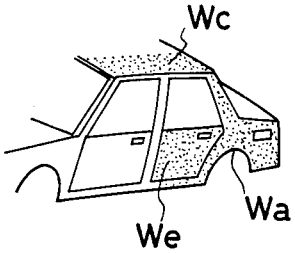
Figure 8C:
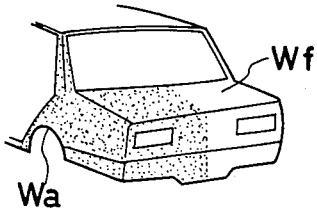
Figure 7D:
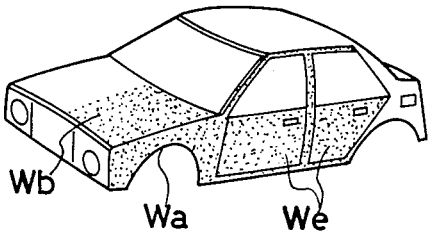
Figure 8D:
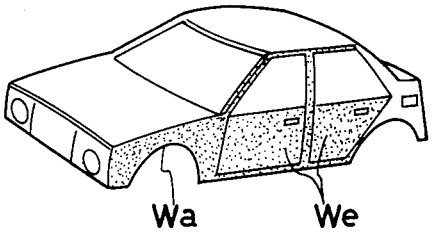

In more detail, a pair of the foregoing painting robots 5 are disposed laterally on the left and right side in the first stage $2_1$, and each of the robots 5 is arranged to be movable forwards and rearwards. The painting robot 5 on the right side denoted by $A_1$ in FIG. 1, paints the wheel arches of the front and rear fenders Wa, Wa on the right side of the vehicle body W, the front end of the right half portion of the bonnet Wb and the front end of the right half portion of the roof Wc as shown in FIG. 4(*a*). The painting robot 5 on the left side denoted by $B_1$, paints the front and rear fenders Wa, Wa on the left side of the vehicle body W, the front end of the left half portion of the bonnet Wb, and the front end of the left half portion of the roof Wc as shown in FIG. 4(*b*).

In the second stage $2_2$, the painting robot 5 denoted by $A_2$ in FIG. 1, paints an inner surface of the right half portion of the trunk lid Wf and an upper edge of the right half portion of the trunk space as shown in FIG. 5(*a*). The painting robot 5 denoted by $B_2$ in FIG. 1, paints the peripheral edge of the front door We on the right side and a door opening portion thereof disposed on the right side in the second stage, as shown in FIG. 5(*b*), while the painting robot 5 denoted by $C_2$ in FIG. 1, paints a peripheral edge of the rear door We on the left side of the vehicle body W and a door opening portion thereof is shown in FIG. 5(*c*). The painting robot 5 denoted by $D_2$ in FIG. 1, paints an inner surface of the left half portion of the bonnet Wb and the right half portion of the engine space Wd. The robots 5 denoted by $C_2$ and $D_2$, are disposed on the left side in the second stage $2_2$.

Additionally, in the third stage $2_3$, the painting robot 5 denoted by $A_3$ paints the peripheral edge of the rear door We on the right side of the vehicle body and a door opening portion thereof as shown in FIG. 6(*a*), and the painting robot 5 denoted by $B_3$ paints an inner surface of the right half portion of the bonnet Wb and a left half portion of the engine space as shown in FIG. 6(*b*). The painting robots 5 denoted by $A_3$ and $B_3$, are disposed on the right side in the third stage $2_3$. The painting robot 5 denoted by $C_3$ paints the inner surface of the left half portion of the trunk lid Wf and an upper edge of the left half portion of the trunk space as shown in FIG. 6(*c*), and the painting robot 5 denoted by $D_3$, paints the peripheral edge of the front door We on the left side and the door opening portion thereof as shown in FIG. 6(*d*), the painting robots 5 denoted by $C_3$ and $D_3$, are disposed on the left side in the third stage $2_3$.

Consequently, the painting of the inner panel region of the vehicle body W can be carried out with high efficiency at the two stages $2_2$, $2_3$, without causing any electrostatic repulsion which would otherwise be caused by mutually approaching of the robots.

The painting robots 5 denoted by the foregoing $A_2$, $D_2B_3$, $C_3$ are movable to advance and withdraw in the lateral direction in relation to the vehicle body W, and the painting robots 5 denoted by the foregoing $B_2C_2$, $A_3$, $D_3$ are movable to advance and withdraw in the longitudinal direction along the vehicle body W.

In the fifth stage $2_5$, the painting robot 5 denoted by $A_5$ paints the upper surface of the right half portion of the roof Wc, the outer surfaces of the rear door We and the rear fender Wa on the right side of the vehicle body W, as shown in FIG. 7(*a*) and the painting robot 5 denoted by $B_5$ paints the outer surface of the front door We on the right side thereof, the upper surface of the right half portion of the bonnet Wb and the outer surface of the front fender Wa on the right side thereof as shown in FIG. 7(*b*). The painting robots 5 denoted by $A_5$ and $B_5$, are disposed on the right side in the fifth stage $2_5$. the painting robot 5 of $C_5$ paints portions symmetrical with the portions to be painted by the painting robot 5 denoted by the foregoing $A_5$ as shown in FIG. 7(*c*), and the painting robot 5 of $D_5$, paints portions symmetrical with the portions to be painted by the painted robot 5 denoted by the foregoing $B_5$, as shown in FIG. 7(*d*). The painting robots 5 denoted by $C_5$ and $D_5$, are disposed on the left side in the fifth stage $2_5$. Additionally, in the sixth stage $2_6$, the painting robot 5 denoted by $A_6$ paints the upper surface of the right half portion of the trunk lid Wf, the outer surface of the rear fender Wa on the right side of the vehicle body W and a rear end surface of the right half portion of the vehicle body W, as shown in FIG. 8(*a*), and the painting robot 5 denoted by $B_6$, paints the right side surface of the vehicle body W ranging from the front fender Wa to the rear door We as shown in FIG. 8(*b*). The painting robots 5 denoted by $A_6$ and $B_6$ are disposed on the right side in the sixth stage $2_6$, while the painting robots 5 denoted respectively by $C_6$ and $D_6$, as shown in FIG. 8(*c*) and FIG. 8(*d*), paint portions symmetrical with the portions to be painted by the painting robots 5 denoted by $A_6$ and $B_6$. The painting robots 5 denoted by $C_6$ and $D_6$, are disposed on the left side in the sixth stage $2_6$. Thus, in these two stages $2_5$, $2_6$, the painting of the entire outer panel region of the vehicle body W, is performed by painting twice the outer surfaces of the fender Wa and the door Wb. Each of the painting robots 5 in the fifth and sixth stages $2_5$, $2_6$ is arranged to be movable forwards and backwards, rightwards and leftwards, and obliquely.

The fourth stage $2_4$ and the seventh stage $2_7$ is a stage are each for pre-drying, and serve to evaporate organic solvent contained in the painted or coated film by air-conditioned air for heightening the solid content of the coated film.

Two paint booths 1, each being constructed as above, are disposed in series with one another and in with a drying hearth so that the vehicle body W may be applied with paint for a surface coating and painting for a finishing coat.

Next, the operation of the foregoing apparatus will be explained as follows:

Every painting robot 5 provided in each of the painting stages $2_1$, $2_2$, $2_3$, $2_5$, $2_6$ in the painting booth 1 comprises a bell-type atomizer 6 attached to a multi-axis robot 5. Thus, the paint transfer efficiency is high, owing to the cooperation thereof with an arrangement in which the vehicle body W is stepwise conveyed and the painting at each stage is carried out when the vehicle body W is stopped. The inner panel region and the outer panel region of the vehicle body W can be painted correctly, so that any supplementary or additional painting is not necessary thereby improving productivity. In addition, there is little dispersion of the paint, so that, even if the respective stages are disposed without being partition from one another, there is no undesired painting caused by a mist of paint coming from the adjacent stage.

If, additionally, the painting stage for painting the corner portions of the vehicle body W is selected as the first stage $2_1$, positioned at the inlet end section of the paint booth, as in the illustrated embodiment, a small amount of paint at the first stage $2_1$ is sufficient, and owing to the cooperation thereof with the improved paint transfer efficiency caused by using the bell-type atomizer 6, there is no dispersion of paint to the outside of the paint booth even if the inlet of the paint booth 1 which is an outwardly opening surface of the first stage $2_1$ is not closed by a door or the like. In addition, owing to the arrangement of the seventh stage $2_7$ on the outlet end of the paint booth the seventh stage $2_7$ is made to be the stage for flushing, and there is not dispersion of the paint to the outside from the outlet of the paint booth, and it is not necessary to provide a door or the like, at the outlet position. Thus, the cost of producing the apparatus can be lowered significantly and the construction of the apparatus can be simplified.

Thus, according to this invention, each painting stage in a paint booth is provided with a painting robot comprising a multi-axis robot carrying a bell-type atomizer attached thereto, and a vehicle body is arranged to be painted at each painting stage while being stepwise conveyed. Thus, the vehicle body can be painted correctly and in sequence and without requiring any supplementary painting, while being synchronized with the tact operation of the production line, thereby greatly improving the productivity. Additionally, the amount of paint which flows away can be decreased, and there are no problems even if the respective stages are disposed in series without leaving a large space therebetween and without providing any partition means therebetween. The installation costs for providing the partitions can be eliminated and the space between the adjacent stages can be decreased. Additionally, a maintenance and an inspection of the apparatus can be facilitated, because different kinds of painting devices are not used as in a reciprocator or the like of a conventional apparatus.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. A painting apparatus for a vehicle body comprising a long paint booth through which the vehicle is conveyed, said paint booth including a plurality of stage means positioned longitudinally in series, at least two of said plurality of stage means being provided with painting robots disposed therein such that while the vehicle body is passed through the painting booth, inner and outer panel regions thereof are painted by said painting robots, wherein the vehicle body is stopped at each of said stage means, and each of the painting robots comprises a multi-axis robot and bell-type atomizer attached thereto, and wherein said plurality of stage means are in communication with one another without partitions therebetween.

2. A painting apparatus as claimed in claim 1, wherein said plurality of stage means includes seven stage means disposed longitudinally in series, said first stage means being located on an inlet side of said paint booth and said seventh stage means being located on an outlet side thereof, and wherein said first stage means is a painting stage for painting corner portions of the vehicle body, said second and third stage means are painting stages for painting an inner panel region of the vehicle body, said fourth stage means is a stage for flushing, said fifth and sixth stage means are painting stages for painting an outer panel region of the vehicle body, and said seventh stage means is a stage for pre-drying.

3. A painting apparatus as claimed in claim 1, wherein at least one of said painting robots is located on one side of said paint booth and at least one of said painting robots is on the other side of said paint booth.

4. A painting apparatus as claimed in claim 1, wherein said stage means includes an air supply duct, an air filter attached to said air supply duct, a paint recovery tank and an air discharge duct.

5. A painting apparatus for a vehicle body comprising: a long paint booth through which the vehicle is conveyed, said paint booth including a plurality of stage means positioned longitudinally in series, at least five of said plurality of stage means being provided with painting robots disposed therein such that while the vehicle body is passed through the painting booth, inner and outer panel regions thereof are painted by said painting robots, said vehicle body being stopped at each of said stage means and each of the painting robots comprising a multi-axis robot and bell-type atomizer attached thereto, said plurality of stage means being in communication with one another without partitions therebetween.

* * * * *